United States Patent [19]

Watanabe et al.

[11] Patent Number: 4,569,611

[45] Date of Patent: Feb. 11, 1986

[54] TYPEWRITER WITH AUTOMATIC PAPER LOADING APPARATUS

[75] Inventors: Tomoyoshi Watanabe; Yuzo Hasegawa; Kuniyasu Makino, all of Nagoya, Japan

[73] Assignee: Brother Kogyo Kabushiki Kaisha, Nagoya, Japan

[21] Appl. No.: 480,237

[22] Filed: Mar. 29, 1983

Related U.S. Application Data

[63] Continuation of Ser. No. 251,875, Apr. 6, 1981, abandoned.

[30] Foreign Application Priority Data

Apr. 15, 1980 [JP] Japan ..... 55-50192

[51] Int. Cl.[4] ..... B41J 13/20; B41J 11/36

[52] U.S. Cl. ..... 400/624; 400/631; 400/639.1; 400/549

[58] Field of Search ..... 400/624, 633, 618, 639.1, 400/639.2, 631, 632, 632.1, 705.5, 549, 568, 279

[56] References Cited

U.S. PATENT DOCUMENTS

| | | | |
|---|---|---|---|
| 2,328,146 | 8/1943 | Hill et al. | 400/631 |
| 4,005,772 | 2/1977 | Kieffer et al. | 400/903 |
| 4,030,726 | 6/1977 | Biedermann | 400/631 |
| 4,173,420 | 11/1979 | Okabe | 400/618 |
| 4,262,894 | 4/1981 | Marano | 400/639.1 |
| 4,266,880 | 5/1981 | Buchanan | 400/549 |
| 4,275,969 | 6/1981 | Matsuhisa et al. | 400/639.1 |
| 4,280,693 | 7/1981 | Matsuhisa et al. | 400/639.1 |
| 4,326,815 | 4/1982 | Kapp | 400/629 |
| 4,360,279 | 11/1982 | Sugiura | 400/631 |
| 4,486,108 | 12/1984 | Tanaka | 400/639.1 |

FOREIGN PATENT DOCUMENTS

| | | | |
|---|---|---|---|
| 2526445 | 12/1976 | Fed. Rep. of Germany | 400/639.1 |
| 2856569 | 7/1979 | Fed. Rep. of Germany | 400/631 |
| 126470 | 9/1980 | Japan | 400/631 |
| WO82/01514 | 5/1982 | PCT Int'l Appl. | 400/639.1 |

OTHER PUBLICATIONS

Klein et al., *Paper Table . . . and Paper Gate,* IBM Technical Disclosure Bulletin, vol. 17, No. 5, pp. 1263–1264, 10/74.

Mathews, *Paper Feed,* IBM Technical Disclosure Bulletin, vol. 18, No. 5, pp. 1305–1306, 10/75.

Dobson et al., *Paper Insertion . . . Option,* IBM Technical Disclosure Bulletin, vol. 21, No. 10, pp. 4107–4108, 3/79.

Lennon, *Power Operated . . . Typewriter,* IBM Technical Disclosure Bulletin, vol. 22, No. 2, pp. 661–663, 7/79.

*Primary Examiner*—William Pieprz

*Attorney, Agent, or Firm*—Browdy and Neimark

[57] ABSTRACT

An automatic paper loading apparatus for a typewriter provided with a platen, feed rolls, and a paper bail. The paper loading apparatus essentially includes a paper alignment member pivotally mounted on a frame, a paper guide carried by a movable carriage, and three controllers, from first to third. The paper alignment member is engaged with the leading edge of an inserted printing paper while the feed rolls are spaced from the platen. The feed rolls are urged on the aligned paper and the paper alignment member is spaced from the platen for being disengaged from the leading edge of the printing paper owing to a manual operation of a lever. Upon operation of a manual member on a keyboard, the first controller drives a platen drive motor for a predetermined time duration so as to feed the paper by a predetermined amount, the second controller drives a carriage drive motor for moving the paper guide to the center portion of the printing line on the surface of the platen so as to guide the leading edge of the paper passing the printing line, and the third controller energizes a solenoid for keeping the paper bail in a position spaced from the platen while the leading edge of the paper passes between the paper bail and the platen.

9 Claims, 8 Drawing Figures

TYPEWRITER WITH AUTOMATIC PAPER LOADING APPARATUS

This application is a continuation of application Ser. No. 251,875, filed Apr. 6, 1981, now abandoned.

SUMMARY OF THE INVENTION

This invention relates to a paper loading apparatus for a typewriter in which a printing paper is automatically loaded to a correct printing position on a platen.

In ordinary typewriters, the printing paper inserting operation is generally carried out by manual handling including manipulation of a paper release lever, rotational operation of the platen, manipulation of a paper bail, etc. It is fairly troublesome work to correctly load a printing paper on the platen ready for printing by performing those operations one after another in good order.

It is a primary object of this invention to provide an improved typewriter capable of eliminating those troublesome manual operations by automatic paper loading to a suitable printing position.

This invention is preferably realized in a typewriter which is provided with a drive motor to drive a paper feed mechanism including a platen and a feed roll located in a paper feed-in side with respect to a printing line of the platen, a carriage for supporting a print head and a paper guide thereon, means for moving the carriage along the printing line of the platen, and an apparatus for automatically loading the paper. The paper loading apparatus in this instance comprises a keyboard including a manual member, first control means and second control means. And the first control means drives the motor for a predetermined period of time upon an operation of the manual member for driving the paper feed mechanism so as to feed the paper to a predetermined position where the leading edge of the paper has passed over the printing line of the platen, and the second control means drives the moving means upon an operation of the manual member for moving the carriage to the center portion of the printing line before the leading edge of the paper has reached the printing line of the platen, so as to guide the leading edge of the paper passing the printing line of the platen by the paper guide.

This invention may be realized in a typewriter which is provided with a drive motor to drive a paper feed mechanism including a platen, and a paper bail located in a paper feedout side with respect to a printing line of the platen and mounted for movement between a closed position in rolling contact with the platen and an open position spaced from the platen, a carriage for supporting a print head and a paper guide thereon, and means for moving the carriage along the printing line of the platen, and an apparatus for automatically loading the paper. The paper loading apparatus comprises a keyboard including a manual member, first control means, second control means, a solenoid operatively connected with the paper bail and third control means.

The first control means drive the motor for a predetermined period of time upon an operation of the manual member for driving the paper feed mechanism so as to feed the paper to a predetermined position where the leading edge of the paper has passed between the platen and the paper bail through the printing line of the platen. The second control means drives the moving means upon an operation of the manual member for moving the carriage to the center portion of the printing line before the leading edge of the paper has reached the printing line, so as to guide the leading edge of the paper passing the printing lined of the platen by the paper guide. The third control means for energizing the solenoid to move the paper bail from the closed position to the open position and to keep it in the open position while the leading edge of the paper passed between the platen and the paper bail.

This invention is further realized in a typewriter including both the feed roll and the paper bail. A paper loading apparatus in this typewriter comprises a paper alignment member pivotally mounted for movement between the closed position and the open position, manually operable means operatively connected with the feed roll and the paper alignment member, a manual member, first control means, second control means, a solenoid operatively connected with the paper bail, and third control means. The paper alignment member is engageable with the leading edge of the inserted paper between the platen and the feed roll positioned in the open position for effecting alignment of the inserted paper when the paper alignment member is in the closed position, and disengageable with the leading edge of the inserted paper when the paper alignment member is in the open position. The manually operable means is positionable between first position for locating the feed roll in the closed position and the paper alignment member in the open position, and second position for locating the feed roll in the open position and the paper alignment member in the closed position. The manually operable means enables the inserted paper to be set in a preset condition. In other words, the inserted paper is aligned by the paper alignment member upon a moving operation of the manually operable means from the first position to the second position, and the aligned paper is pressed between the platen and the feed roll upon a moving operation of the manually operable means from the second position to the first position. This control means drives the motor for a predetermined period of time upon an operation of the manual member for driving the paper feed mechanism so as to feed the inserted paper in the preset condition to a predetermined position where the leading edge of the inserted paper has passed between the platen and the paper bail through the printing line of the platen. The second control means drives the moving means upon an operation of the manual member for moving the carriage to the center portion of the printing line before the leading edge of the inserted paper has reached the printing line, so as to guide the leading edge of the inserted paper passing the printing line of the platen by the paper guide. The third control means energizes the solenoid to move the paper bail from the closed position to the open position and to keep it there while the leading edge of the paper passes between the platen and the paper bail.

The paper loading apparatus including a manually operated paper alignment member described above, is fully automated in advancement of a sheet of paper but remains to be manually operated in terms of sheet insertion and alignment. The manually operated alignment and feed roller arrangement is maintained because it has practical advantages and because its automation pushes up the overall cost of a typewriter to a considerable extent. The manually operable means is operative independently of sheet supply from feed rollers or independently of detection of the leading edge of a sheet, and therefore there is no need of providing complicated and costly linkages connecting the sheet supply rollers with sheet alignment pawls and pressing rollers.

On the other hand, a paper advancing part of the loading apparatus of the invention is automated, i.e., means is provided for automatically advancing a sheet which has been manually inserted and aligned. Particularly in a typewriter using stepper motors to drive a platen and a carriage, coordination of the platen rotation, carriage centering and pivotal movement of paper bail is comparatively easily accomplished by means of suitable control circuits which are currently available at relatively low cost.

Thus, the loading apparatus stated just above, is a unique combination of paper insertion, alignment and advancing assemblies in respect of whether they should be operated manually or automatically from the standpoint of cost-benefit ratio associated with automation of such assemblies.

DETAILED DESCRIPTION OF THE PREFERRED EMBODIMENT

Figure 1:
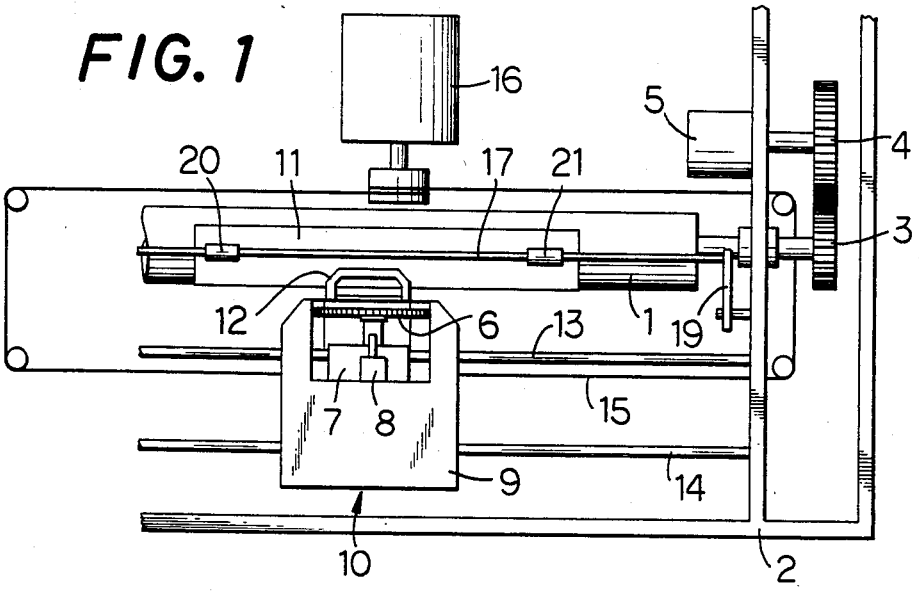
FIG. 1 is a rough plan view of a typewriter in accordance with this invention.

A platen 1 is rotatably attached to a machine frame 2 and connected by way of gears 3, 4 to a pulse motor 5 which is supported by the machine frame 2. A carriage 10 is placed on guide bars 13, 14 mounted parallelly to the platen 1 on the machine frame 2. The carriage 10 is via a wire 15 connected to a pulse motor 16 for being laterally, leftwards and rightwards, driven in a parallel direction to the platen 1 in response to forward and backward rotation of the pulse motor 16. On the carriage 10 a type wheel or print wheel 6 having a plurality of radially arranged arms, a pulse motor 7 for rotating the same, a hammer 8 for striking a type on the arm selected on the print wheel 6, and an ink-ribbon cartridge 9, etc. are placed. A paper guide 12, for guiding a printing paper 11 on the platen 1 so as to make it rightly accord with a printing surface of the platen 1 and functioning as an indicator of a printing line and a printing position on the platen 1, is also mounted on the carriage 10.

Figure 2:
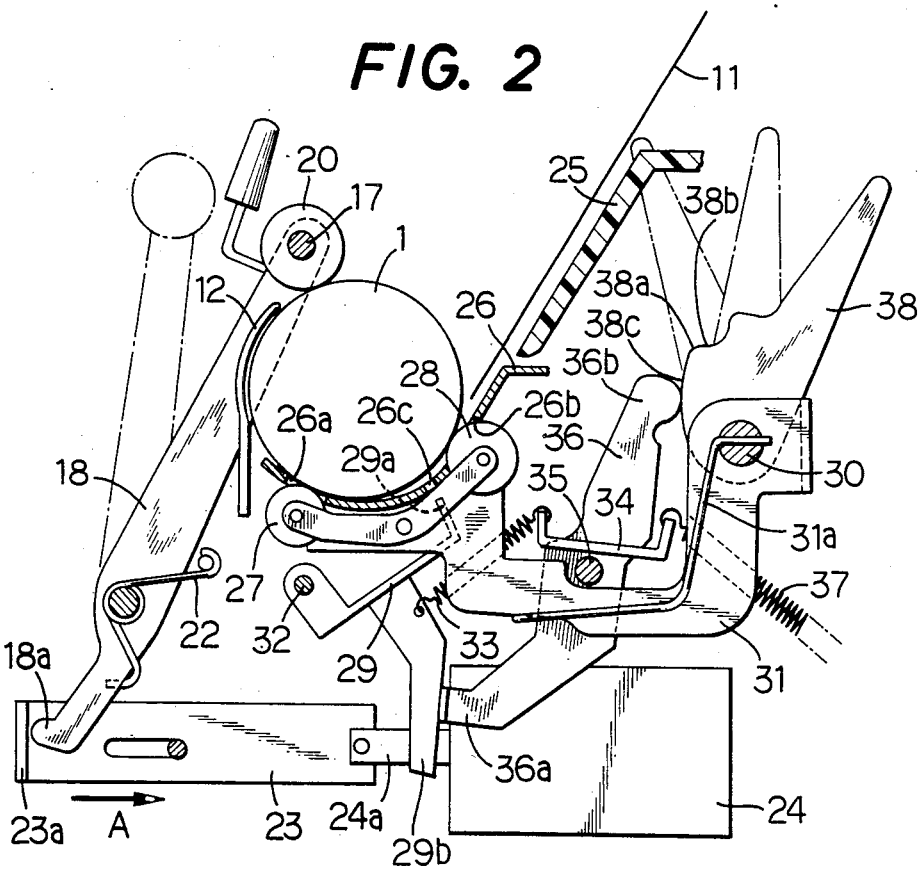
FIG. 2 is a cross sectional view of an essential part of the typewriter shown in FIG. 1.

A paper bail 17 is anchored between a pair of arms 18, 19 which are pivoted on the machine frame 2. A pair of rollers 20, 21 are disposed at intermediate positions of the paper bail 17 for gripping the printing paper 11, at a slightly upper portion than the printing line, with the aid of the platen 1 from either side. Those rollers 20, 21 are, following the rotation of the platen 1, rotated at the state of gripping the printing paper 11 so as to feed it while maintaining it suitably contacted with the peripheral surface of the platen 1. As shown in FIG. 2, a wire spring 22 is disposed coaxially with the arm 18 for biasing the same in clockwise direction, so that the rollers 20, 21 are kept in good abutting status with the platen 1.

A transmitting member 23 is movably supported by the machine frame 2, whose one end is connected to a plunger 24*a* of a solenoid 24 and the other end is provided with a bent-up portion 23*a* for being engageable with a tail portion 18*a* of the arm 18. Pulling action of the solenoid 24 moves the transmitting member 23 in the direction of arrow A, which rotates in turn the arm 18 as far as a position indicated with a one-dot-chain line in FIG. 2 accompanied by separation of the paper bail 17 and the rollers 20, 21 from the platen 1.

A paper supporter 25 and a paper pan 26 guide the printing paper 11 which runs from the rear side of the platen 1 passing the bottom side thereof to the front side. In the paper pan 26 through-bores 26*a*, 26*b*, and 26*c* are formed so as to allow the tip of urging rollers 27, 28 as feed rolls three pairs being disposed along the platen 1, only onr pair being shown and a tip 29*a* of a paper stopper 29 as a paper alignment member to abut onto the peripheral surface of the platen 1. The urging rollers 27, 28 are rotatably carried by a swing lever 31 which is pivoted on a shaft 30 supported by the machine frame 2. The swing lever 31 is biased clockwise in FIG. 2 by a wire spring 31*a* to cause both rollers 27, 28 to be in a pressed state on the peripheral surface of the platen 1, through which the printing paper 11 gripped between the two can be fed to the printing position without being slackened owing to the following rotation of the rollers 27, 28 after the rotation of the platen 1.

The paper stopper 29 pivoted on a shaft 32 is connected through a coil spring 33 to a member 34 for being biased anti-clockwise in FIG. 2, and a lower end 29*b* of the paper stopper 29 is abutted on a tail portion 36*a* of a rotating arm 36 pivoted on a shaft 35, with a result of keeping the tip 29*a* of the paper stopper 29 separated from the platen 1. As the member 34 is secured on the rotating arm 36 and a coil spring 37 stronger than the coil spring 33 is spanned between the member 34 and the machine frame 2, the rotating arm 36 is constantly subjected to clockwise rotational force.

A paper release lever 38 is pivoted on the shaft 30, and a third cam surface 38*c* thereof is in abutment by a tip portion 36*b* of the rotating arm 36 when the paper release lever 38 is in its original position shown with a solid line in FIG. 2. Therefore the tip 29*a* of the paper stopper 29 is kept in a separated status from the peripheral surface of the platen 1, resisting the biasing force of the coil spring 33, and the urging rollers 27, 28 are kept in abutment under pressure on the peripheral surface of the platen 1 due to the biasing force of the wire spring 31*a*.

Figure 5:
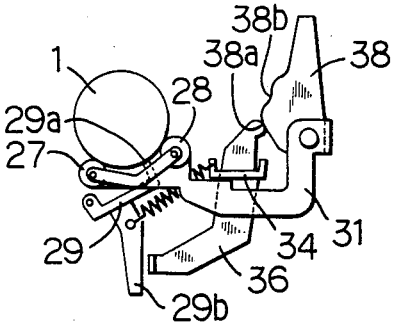
FIGS. 5 to 8 are respectively an explanatory view for explaining paper loading operation.
Figure 6:
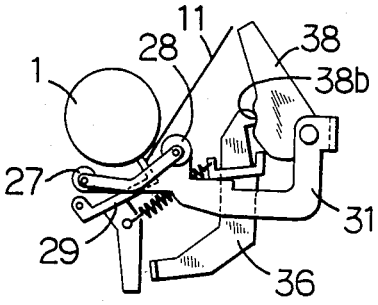

When the paper release lever 38 is manually rotated from the original position shown with the solid line in FIG. 2 to an intermediate rotational position shown with a one-dot-chain line in the same figure, a first cam surface 38*a* thereof rotates somewhat the rotating arm 36 in an anti-clockwise direction, as shown in FIG. 5, so as to cause the tip 29*a* of the paper stopper 29 to abut on the peripheral surface of the platen 1 at an intermediate position between the abutment positions of the urging rollers 27, 28. When the paper release lever 38 is in the final rotational position shown in FIG. 2 with a two-dot-chain line, a second cam surface 38*b* thereof comes to engage with a tip portion 36*b* of the rotating arm 36. In the meantime to this engagement the rotating arm 36 is anti-clockwise rotated in larger amount than in the previous time, so the swing lever 31 is anti-clockwise rotated by the member 34 resisting the biasing force of the wire spring 31*a* so as to place the urging rollers 27, 28 in a separated status from the peripheral surface of the platen 1 as shown in FIG. 6. When the printing paper 11 is inserted from the rear side of the platen 1 in such a status, the leading edge thereof passes through a clearance between the urging roller 28 and the platen 1 as far as it abuts the tip 29*a* of the paper stopper 29 to be blocked of its advancing there.

Figure 7:
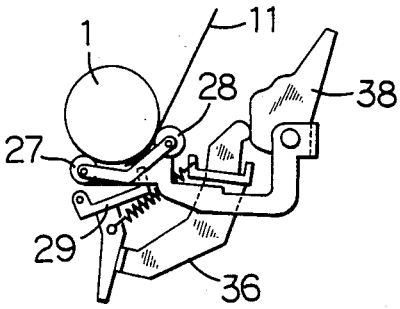

When the paper release lever 38 is, with the leading edge of the printing paper 11 being abutted on the paper stopper 29, returned by manual operation or by a not shown electromagnetic mechanism toward the original position, the urging rollers 27, 28 are placed in abutment on the platen 1, while the paper release lever 38 is moved from the final rotational position to the intermediate rotational position. And by the time when the same is returned to the original position, passing through the intermediate rotational position, the paper stopper 29 is separated from the platen 1 to reach the status shown in FIG. 7. At a time when the rotational operation of the paper release lever 38 has been terminated, the printing paper 11 is in pressed status between the platen 1 and the urging roller 28 at a position away from the leading edge thereof by a predetermined distance.

Figure 3:
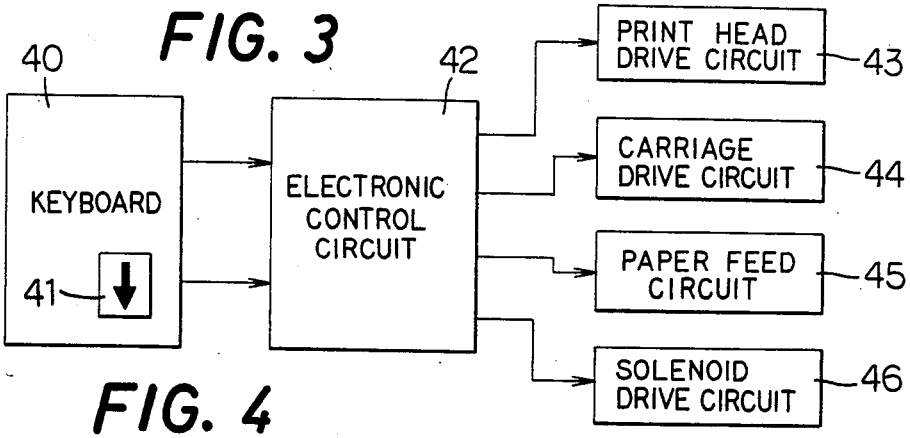
FIG. 3 is a block diagram of an electric system of the typewriter shown in FIGS. 1 and 2.

In a keyboard 40 illustrated in FIG. 3 many letter keys, symbol keys, various function keys, and a printing paper loading key 41 which is closely related to this invention are arranged. Operation of each key is detected by an electronic control circuit 42 which is composed of a microprocessor, ROM (read-only memory), and RAM (random access memory). This circuit 42 is for controlling printing operation and various other operations related thereto corresponding to the key operation in the keyboard 40. Typewriters having such a structure were developed a few years ago to be broadly available. Only the control operation related to this invention will be described, omitting description of the detailed internal structure.

A print head drive circuit 43 drives the pulse motor 7 and the hammer 8 based on a print control signal from the electronic control circuit 42 for executing the strike operation on a desired type of the print wheel 6 by the hammer 8, so that a letter may be printed thereby on the printing paper 11. A carriage drive circuit 44 rotatingly drives the pulse motor 16, based on a movement control signal from the electronic control circuit 42, for moving the carriage 10 to a desired position faced to the platen 1. A printing paper feed circuit 45 rotatingly drives the pulse motor 5 operatively connected to the platen 1 based on a feed control signal from the electronic control circuit 42, so that the printing paper 11 may be advanced or retracted by a desired amount. A solenoid drive circuit 46 energizes and deenergizes a solenoid 24 for driving the paper bail 17 based on a separation control signal from the electronic control circuit 42.

Printing paper loading operation on a typewriter of such a structure will be explained next. In a preset status of the printing paper 11 described in regard to FIG. 2, viz., a status of the printing paper 11 gripped between the platen 1 and the urging roller 28 at a position away from the leading edge thereof by a predetermined distance, operation of the printing paper loading key 41 will cause the electronic control circuit 42 to generate a predetermined number of pulse signals toward the printing paper feed circuit 45, for rotating the pulse motor 5 by a predetermined amount and simultaneously controlling the solenoid drive circuit 46 so as to continuously energize the solenoid 24 for a predetermined duration of time, it will further control, in parallel with the above control operations, the carriage drive circuit 44 for driving the pulse motor 16 so as to thereby position the carriage 10 at approximately center of the printing line of the platen 1.

Figure 4:
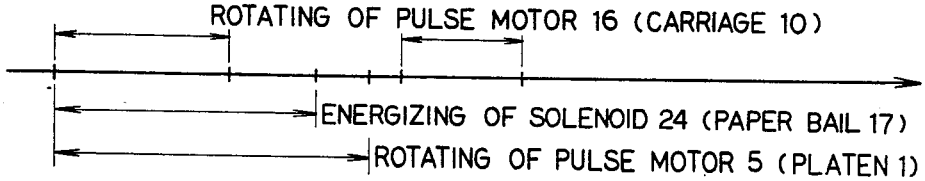
FIG. 4 is a timing chart for explaining the automatic paper loading operation.
Figure 8:
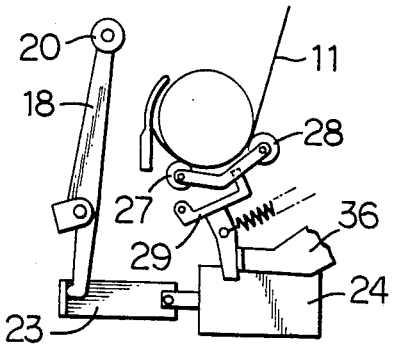

The printing paper 11 can be due to such a control operation of the electronic control circuit 42 advanced by a predetermined amount in this way to be suitably placed at the initial printing position after the leading edge thereof has passed the printing line on the platen 1. In the meantime the paper bail 17 is shifted due to the above-mentioned energization of the solenoid 24 from the solid lined position in FIG. 2 to the one-dot-chain lined release position so as to be separated from the platen 1, followed by moving of the carriage 10 to an almost center position of the printing line of the platen 1. The printing paper 11 can thereby be guided, as shown in FIG. 8, by the paper guide 12 of the carriage 10 for being fed into between the platen 1 and the paper bail 17 in release position. When later the solenoid 24 is deenergized to return the paper bail 17 to the original position so that the latter urges the printing paper 11 against the platen 1, and the carriage 10 is returned to its home position, the left end in FIG. 1. All of the above stated operations are performed, by manual operation of the printing paper loading key 41, in the order illustrated in the timing chart of FIG. 4.

Another depressing operation of the printing paper loading key 41 taking place by chance in the course of the series of operations started by the first depressing operation thereof will not be stored or memorized, unlike the depressing operation of the letter keys, symbol keys, and function keys, but cancelled. When a typewriter is so designed that the width of the preset printing paper can be recognized by a suitable detector or the electronic control circuit 42 operated by a key on the key board 40, the position of the carriage 10 for helping the automatic loading of the printing paper 11 can be the center of the printing paper 11. The width of the paper guide 12 should be determined as large as possible within a limit of not interfering other parts or mechanisms. When an electromagnetic device is disposed for automatically returning the paper release lever 38, the latter is preferably returned due to an operation of the printing paper loading key 41 before the rotation of the pulse motor 5.

What is claimed is:

1. In a typewriter having: a paper advance stepper motor to drive a paper feed mechanism including a platen, a feed roll located on a paper feed-in side of a printing line of the platen and movable between its closed position adjacent the platen and its open position spaced from the platen, and a paper bail located on a paper feed-out side of the printing line and movable between its closed position and its open position; a carriage for supporting a print head and a paper guide thereon; a carriage drive stepper motor for moving the carriage along the printing line of the platen; and an apparatus for loading a sheet of paper, the improvement wherein said loading apparatus comprises:

a paper alignment member pivotally mounted downstream of said feed roll for movement between its closed position and its open position, said paper alignment member being engageable, when set in the closed position, with the leading edge of the paper manually inserted between the platen and said feed roll located in the open position so as to effect alignment of the inserted paper, and disengageable from the leading edge of the inserted paper when set in the open position;

manually operable means, operatively connected with said feed roll and said alignment member and movable between its first and second positions, for locating said feed roll in the closed position and the paper alignment member in the open position when said manually operable means is set in said first position, and locating said feed roll in the open position and said paper alignment member in the closed position when said manually operable means is set in said second position, said manually operable means thereby enabling said paper alignment member to align the inserted paper upon movement thereof from said first position to said second position, and enabling said feed roll to press the aligned paper against the surface of the platen upon movement thereof from said second position to said first position;

a manual member;

a solenoid operatively connected to said paper bail to move same between the closed and open positions with a force produced by energization thereof; and electric control means for, in response to an operation of said manual member, (a) actuating said paper advance stepper motor for driving said paper feed mechanism so as to feed the paper transversely of the platen to a predetermined position at which the leading edge of the paper is moved past between the platen and said paper bail across the printing line of the platen, (b) actuating said carriage drive stepper motor for moving said carriage to a center position of the printing line before the leading edge of the paper has reached the printing line so as to enable said paper guide to guide the leading edge of the paper passing the printing line, and (c) energizing said solenoid to move said paper bail from its closed position to its open position and keep said paper bail in the open position until the leading edge of the paper has passed between the platen and said paper bail.

2. A typewriter as set forth in claim 1, wherein said electric control means controls said paper advance stepper motor so as to be actuated for a first period of time, and said carriage drive stepper motor for a second period of time shorter than said first period, and said solenoid for a third period of time shorter than said first period and longer than said second period, said first, second and third periods of time being started when said manual member is operated.

3. A typewriter as set forth in claim 2, wherein said loading apparatus further comprises pivot arms connected to said paper bail at one end thereof and to said solenoid at the other end, and pivoted about a portion thereof between said one and the other ends, whereby linear movements of said solenoid are converted into pivotal movements of said pivot arms.

4. A typewriter as set forth in claim 1, wherein said loading apparatus further comprises pivot arms connected to said paper bail at one end thereof and to said solenoid at the other end, and pivoted about a portion thereof between said one and the other ends, whereby linear movements of said solenoid are converted into pivotal movements of said pivot arms.

5. A typewriter as set forth in claim 1, wherein said loading apparatus further comprises a rotating arm engageable at one end thereof with said manually operable means and at the other end thereof with said paper alignment member to keep same in the open position when said manually operable means is set in said first position, and further comprises a swing lever carrying said feed roll at one end thereof and engageable with said rotating arm to keep said feed roll in the open position when said manually operable means is set in said second position.

6. A typewriter as set forth in claim 5, wherein said paper alignment means is biased toward its closed position and said swing arm is biased in a direction to cause said feed roll to be pressed against the surface of said platen.

7. In a typewriter having: a paper advance stepper motor to drive a paper feed mechanism including a platen, a feed roll located on a paper feed-in side of a printing line of the platen and movable between its closed position adjacent to the platen and its open position spaced from the platen, and a paper bail located on a paper feed-out side of the printing line and movable between its closed position and its open position; a carriage for supporting a print head and a paper guide thereon; a carriage drive stepper motor for moving the carriage along the printing line of the platen; and an apparatus for loading a sheet of paper, the improvement wherein said loading apparatus comprises;

a paper stopper pivotally mounted downstream of said feed roller for movement between its closed position and its open position, said paper stopper being engageable, when set in the closed position, with the leading edge of the paper manually inserted between the platen and said feed roll located in the open position so as to effect alignment of the inserted paper, and disengageable from the leading edge of the inserted paper when set in the open position;

a paper release lever manually movable between its first and second positions;

a rotating arm engageable at one end thereof with said paper release lever and at the other end thereof with said paper stopper to keep the paper stopper in the open position when said paper release lever is set in said first position, and to keep the paper stopper in the closed position when the paper release lever is set in said second position;

a swing lever carrying said feed roll at one end thereof and engageable with said rotating arm to keep said feed roll in the open position when said paper release lever is set in said second position, and to keep the feed roll in the closed position when the paper release lever is set in the first position, said paper release lever thereby enabling said paper stopper to align the inserted paper upon movement thereof from said first position to said second position, and enabling said feed roll to press the aligned paper against the surface of the platen upon movement thereof from said second position to said first position;

a manual member;

a solenoid operatively connected to said paper bail to move the paper bail between the closed and open positions with a force produced by energization thereof; and electric control means for, in response to the an operation of said manual member, (a) actuating said paper advance stepper motor for a first period of time, for driving said paper feed mechanism so as to feed the paper transversely of the platen to a predetermined position at which the leading edge of the paper is moved past between the platen and said paper bail across the printing line of the platen, (b) actuating, said carriage drive stepper motor for a second period of time shorter than said first period, for moving said carriage to a center position of the printing line before the leading edge of the paper has reached the printing line so as to enable said paper guide to guide the leading edge of the paper passing the printing line, and (c) energizing, said solenoid for a third period of time shorter than said first period and longer than said second period, to move said paper bail from its closed position to its open position and keep said paper bail in the open position until the leading edge of the paper has passed between the platen and said paper bail, said first, second and third periods of time being started when said manual member is operated.

8. A typewriter as set forth in claim 7, wherein said paper stopper is biased toward its closed position and said swing arm is biased in a direction to cause said feed roll to be pressed against the surface of the platen.

9. A typewriter as set forth in claim 7, wherein said loading apparatus further comprises pivot arms connected to said paper bail at one end thereof and to said solenoid at the other end, and pivoted about a portion thereof between said one and the other ends, whereby linear movements of said solenoid are converted into pivotal movements of said pivot arms.

* * * * *